US005351768A

United States Patent [19]

Scott et al.

[11] Patent Number: 5,351,768

[45] Date of Patent: Oct. 4, 1994

[54] EARTH-BORING BIT WITH IMPROVED CUTTING STRUCTURE

[75] Inventors: Danny E. Scott, Houston; Robert E. Grimes, Cypress; Matthew R. Isbell; Rudolf C. O. Pessier, both of Houston, all of Tex.

[73] Assignee: Baker Hughes Incorporated, Houston, Tex.

[21] Appl. No.: 89,318

[22] Filed: Jul. 8, 1993

[51] Int. Cl.[5] ..... E21B 10/00

[52] U.S. Cl. ..... 175/374; 175/371

[58] Field of Search ..... 175/331, 341, 374

[56] References Cited

U.S. PATENT DOCUMENTS

| | | | |
|---|---|---|---|
| 2,804,282 | 8/1957 | Spengler, Jr. et al. | 225/345 |
| 2,990,025 | 6/1961 | Talbert et al. | 175/375 |
| 3,401,759 | 9/1968 | White | 175/341 |
| 3,952,815 | 4/1976 | Dysart | 175/374 |
| 4,832,139 | 5/1989 | Minikus et al. | 175/374 |
| 4,940,099 | 7/1990 | Deane et al. | 175/374 |
| 5,201,376 | 4/1993 | Williams | 175/374 |
| 5,287,936 | 2/1994 | Grimes et al. | 175/331 |

*Primary Examiner*—William P. Neuder

*Attorney, Agent, or Firm*—Robert A. Felsman; Mark D. Perdue

[57] ABSTRACT

An earth-boring bit has a bit body and at least one cutter rotatably secured to the bit body. The cutter has a cutter shell surface including a gage surface intersecting a heel surface. A plurality of hard metal inserts are arranged in generally circumferential rows on the cutter and include a heel row of heel inserts on the heel surface of the cutter and a gage row of gage inserts on the gage surface of the cutter. At least one scraper insert, formed of material more wear-resistant than that of the cutter shell surface, is secured to the cutter shell surface generally at the intersection of the gage and heel surfaces. The scraper insert includes a gage and a heel insert surface. The gage and heel surfaces of the scraper insert converge to define a cutting edge for engagement with the sidewall of the borehole, the insert surface defining a positive rake angle with respect to the sidewall of the borehole of between 0 and 15 degrees. The cutting edge projecting from the heel surface an amount not greater than the lesser of one-half the projection of the heel inserts from the heel surface and 30% of the pitch between the heel inserts.

11 Claims, 5 Drawing Sheets

EARTH-BORING BIT WITH IMPROVED CUTTING STRUCTURE

BACKGROUND OF THE INVENTION

1. Field of the Invention

The present invention generally relates to earth-boring drill bits. More particularly, the present invention relates to improved cutting structures or geometries for earth-boring drill bits.

2. Background Information

The success of rotary drilling enabled the discovery of deep oil and gas reservoirs. The rotary rock bit was an important invention that made the success of rotary drilling possible. Only soft earthen formations could be penetrated commercially with the earlier drag bit, but the two-cone rock bit, invented by Howard R. Hughes, U.S. Pat. No. 930,759, drilled the caprock at the Spindletop field, near Beaumont, Tex. with relative ease. That venerable invention within the first decade of this century could drill a scant fraction of the depth and speed of the modern rotary rock bit. The original Hughes bit drilled for hours, the modern bit drills for days. Modern bits sometimes drill for thousands of feet instead of merely a few feet. Many advances have contributed to the impressive improvements in rotary rock bits.

In drilling boreholes in earthen formations by the rotary method, rotary rock bits having one, two, or three rolling cutters rotatably mounted thereon are employed. The bit is secured to the lower end of a drillstring that is rotated from the surface or by downhole motors or turbines. The cutters mounted on the bit roll and slide upon the bottom of the borehole as the drillstring is rotated, thereby engaging and disintegrating the formation material to be removed. The roller cutters are provided with teeth that are forced to penetrate and gouge the bottom of the borehole by weight from the drillstring.

The cuttings from the bottom and sides of the borehole are washed away by drilling fluid that is pumped down from the surface through the hollow rotating drillstring, and are carried in suspension in the drilling fluid to the surface. The form and location of the teeth or inserts upon the cutters have been found to be extremely important to the successful operation of the bit. Certain aspects of the design of the cutters becomes particularly important if the bit is to penetrate deep into a formation to effectively strain and induce failure in the formation material.

The current trend in rolling cutter earth-boring bit design is toward coarser, more aggressive cutting structures or geometries with widely spaced teeth or inserts. These widely spaced teeth prevent balling and increase bit speed through relatively soft, low compressive strength formation materials such as shales and siltstones. However, large spacing of heel teeth or inserts permits the development of large "rock ribs," which originate in the corner and extend up the wall of the borehole. In softer, low compressive strength formations, these rock ribs form less frequently and do not pose a serious threat to bit performance because they are disintegrated easily by the deep, aggressive cutting action of even the widely spaced teeth or inserts.

In hard, high compressive strength, tough, and abrasive formation materials, such as limestones, dolomites and sandstones, the formation of rock ribs can affect bit performance seriously, because the rock ribs are not destroyed easily by conventional cutter action due to their inherent toughness and high strength. Because of the strength of these materials, tooth or insert penetration is reduced, and the rock ribs are not as easily disintegrated as in the softer formation materials. Rock ribs formed in high compressive strength, abrasive formation materials can become quite large, causing the cutter to ride up on the ribs and robbing the teeth or inserts of the unit load necessary to accomplish effective penetration and crushing of formation material.

Maintenance of the gage or diameter of the borehole and reduction of cutter shell erosion in hard, tough, and abrasive formations is more critical with the widely spaced tooth type of cutting structure, because fewer teeth or inserts are in contact with the borehole bottom and sidewall, and more of the less abrasion-resistant cutter shell surface can come into contact with the borehole bottom and sidewall. Rock ribs can contact and erode the cutter shell surface around and in between heel and gage inserts, sometimes enough to cause insert loss. Additionally, wear may progress into the shirttails of the bit, which protect the bearing seals, leading to decreased bearing life.

Provision of cutters with more closely spaced teeth or inserts reduces the size of rock ribs in hard, tough, and abrasive formations, but leads to balling, or clogging of cutting structure, in the softer formation materials. Furthermore, the presence of a multiplicity of closely spaced teeth or inserts reduces the unit load on each individual tooth and slows the rate of penetration of the softer formations.

As heel inserts wear, they become blunted and more of the cutter shell surface is exposed to erosion. Extensive cutter shell erosion leads to a condition called "rounded gage." In the rounded gage condition, both the heel inserts and the cutter shell surface wear to conform generally to the contours of the corner of the borehole, and the gage inserts are forced to bear the entire burden of maintaining a minimum borehole diameter or gage. Both of these occurrences generate undesirable increase in lateral forces on the cutter, which lower penetration rates and accelerate wear on the cutter bearing and subsequent bit failure.

One way to minimize cutter shell erosion is to provide small, flat-topped compacts in the heel surface of the cutter alternately positioned between heel inserts, as disclosed in U.S. Pat. No. 3,952,815, Apr. 27, 1976, to Dysart. However, such flat-topped inserts do not inhibit the formation of rock ribs. The flat-topped inserts also permit the gage inserts to bear an undesirable proportion of the burden of maintaining minimum gage diameter.

U.S. Pat. No. 2,804,242, Aug. 27, 1957, to Spengler, discloses gage shaving teeth alternately positioned between heel teeth, the shaving teeth having outer shaving surfaces in the same plane as the outer edges of the heel teeth to shave the sidewall of the borehole during drilling operation. The shaving teeth are preferably one-half the height of the heel teeth, and thus function essentially as part of the primary heel cutting structure. In the rounded condition, the shaving teeth conform to the corner of the borehole, reducing the unit load on the heel teeth and their ability to penetrate and disintegrate formation material. The shaving teeth disclosed by Spengler are generally fragile and thus subject to accelerated wear and rapid rounding, exerting the undesirable increased lateral forces on the cutter discussed above.

A need exists, therefore, for an earth-boring bit having an improved ability to maintain an efficient cutting geometry as the bit encounters both hard, high-strength, tough and abrasive formation materials and soft, low-strength formation materials and as the bit wears during drilling operation.

SUMMARY OF THE INVENTION

A principal object of the present invention is to provide an earth-boring bit having an improved ability to maintain an efficient cutting geometry or structure as the earth-boring bit alternately encounters hard and soft formation materials and as the bit wears during drilling operation in borehole. This and other objects of the present invention are achieved by providing an earth-boring bit having a bit body and at least one cutter rotatably secured to the bit body. The cutter has a cutter shell surface including a gage surface intersecting a heel surface. A plurality of hard metal inserts are arranged in generally circumferential rows on the cutter and include a heel row of heel inserts on the heel surface of the cutter and a gage row of gage inserts on the gage surface of the cutter. The bit is further provided with a secondary cutting structure comprising at least one scraper insert, formed of material more wear-resistant than that of the cutter shell surface. The scraper insert is secured to the cutter shell surface generally at the intersection of the gage and heel surfaces and generally intermediate a pair of heel inserts. The scraper insert includes a gage insert surface and a heel insert surface. The gage and heel surfaces of the scraper insert converge to define a cutting edge for engagement with the sidewall of the borehole, wherein the scraper insert prevents the cutter shell surface from engaging with and being worn to conform to the sidewall of the borehole as the heel inserts wear as the bit encounters hard, tough, and abrasive streaks.

According to a preferred embodiment of the present invention, the cutting edge of the scraper insert projects from the heel surface of the cutter not greater than the lesser of 30% of the pitch between the heel inserts and one-half of the projection of the heel inserts from the heel surface.

According to a preferred embodiment of the present invention, one of the gage and heel insert surfaces of the scraper insert is formed of a more wear-resistant material than the other surface, wherein the scraper insert is self-sharpening.

Other objects, features, and advantages of the present invention will be apparent with reference to the figures and detailed description of the preferred embodiment, which follow.

DESCRIPTION OF THE PREFERRED EMBODIMENT

Figure 1:
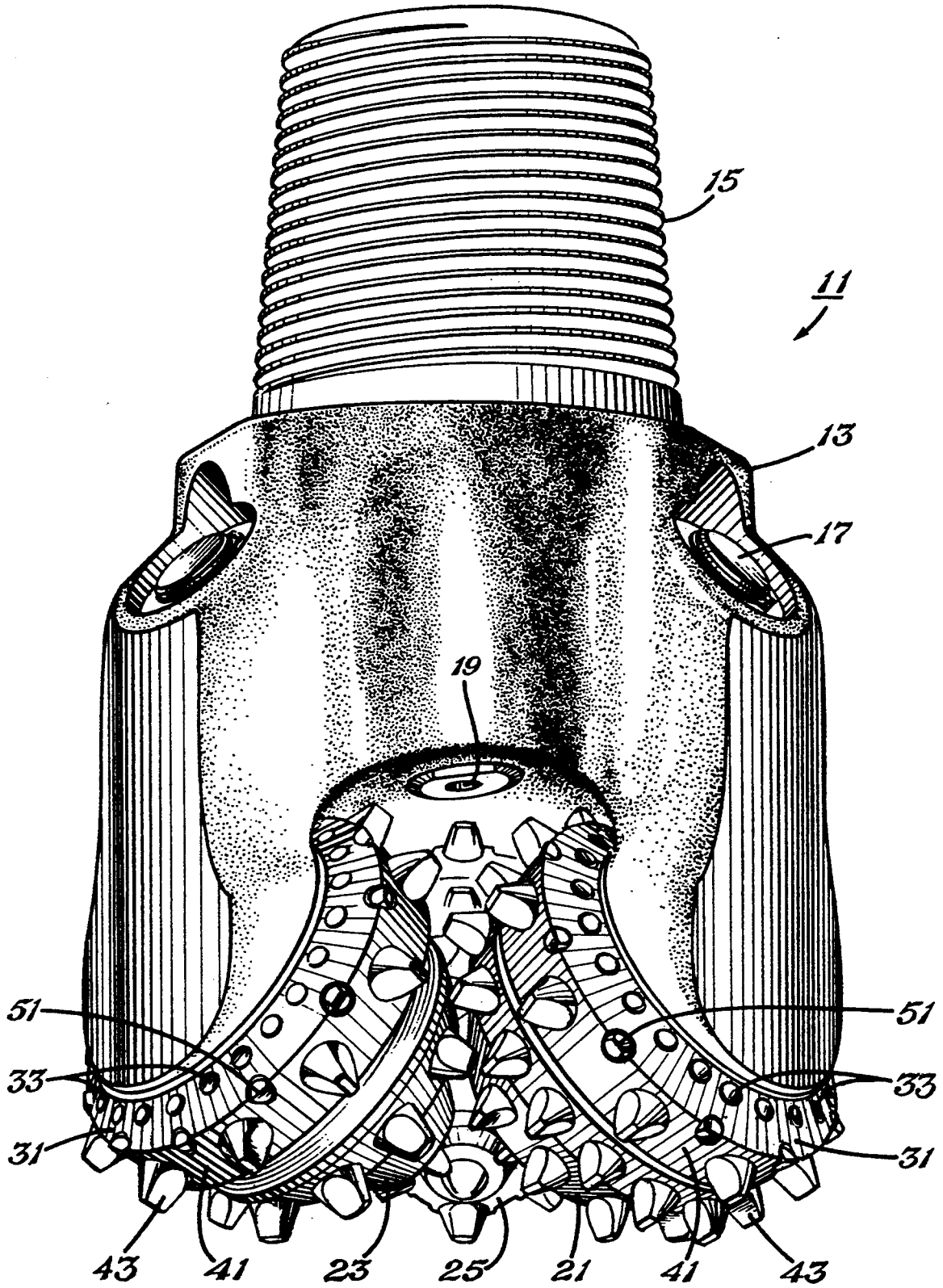
FIG. 1 is a perspective view of an earth-boring bit according to the present invention.

Referring now to FIG. 1, an earth-boring bit 11 according to the present invention is illustrated. Bit 11 includes a bit body 13, which is threaded at its upper extent 15 for connection into a drillstring. Each leg of bit 11 is provided with a lubricant compensator 17, a preferred embodiment of which is disclosed in U.S. Pat. No. 4,276,946, Jul. 7, 1981, to Millsapps. At least one nozzle 19 is provided in bit body 13 to spray drilling fluid from within the drillstring to cool and lubricate bit 11 during drilling operation. Three cutters 21, 23, 25 are rotatably secured to each leg of bit body 13. Each cutter 21, 23, 25 has a cutter shell surface including a gage surface 31 and a heel surface 41.

A plurality of teeth, in the form of hard metal inserts, are arranged in generally circumferential rows on each cutter. Each cutter 21, 23, 25 has a gage surface 31 with a row of gage inserts 33 thereon. A heel surface 41 intersects each gage surface 31 and has at least one row of heel inserts 43 thereon.

At least one scraper insert 51 is secured to the cutter shell surface at the intersection of gage and heel surfaces 31, 41 and generally intermediate a pair of heel inserts 43. Preferably, a scraper insert 51 is located between each heel insert 43, in an alternating arrangement. As is more clearly illustrated in FIGS. 4–5, scraper insert 51 comprises a generally cylindrical body 53, which is adapted to be received in an aperture in the cutter shell surface at the intersection of gage and heel surfaces 31, 41. Preferably, scraper insert 51 is secured within the aperture by an interference fit. Extending upwardly from generally cylindrical body 53 are a pair of insert surfaces 55, 57, which converge to define a cutting edge 59. Preferably, cutting edge 59 is oriented circumferentially, i.e., normal to the axis of rotation of each cutter 21, 23, 25.

Figure 3A:
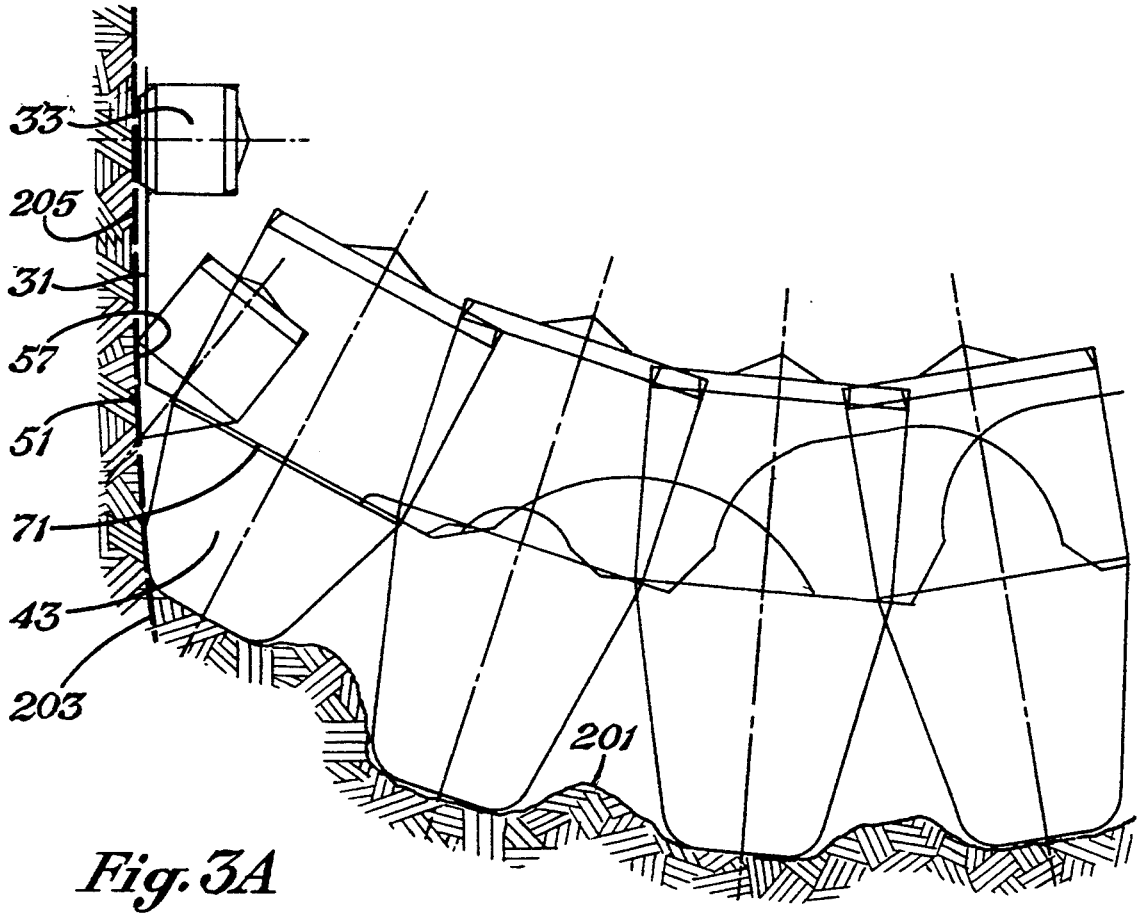
FIGS. 3A through 3C are fragmentary, longitudinal section views of the progressive wear of an earth-boring bit according to the present invention.
Figure 3B:
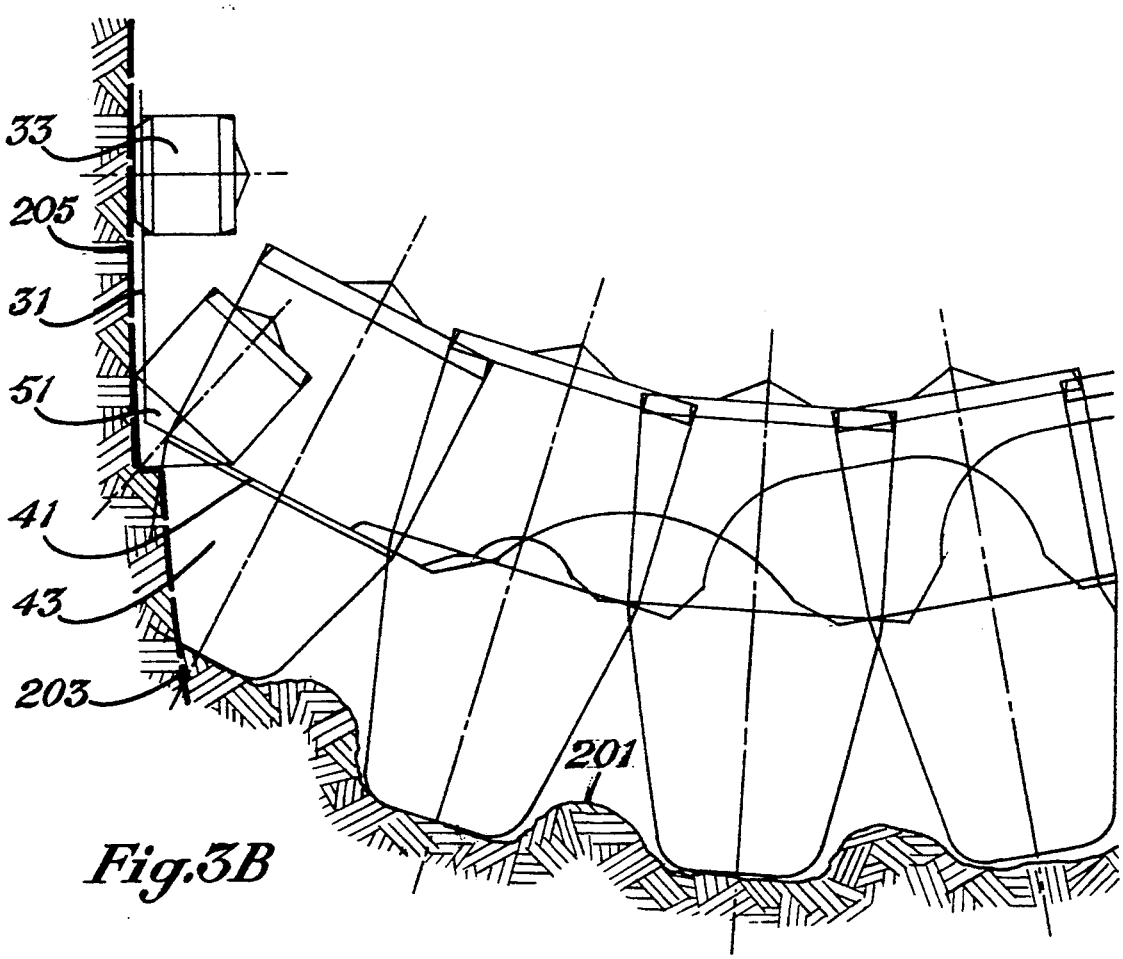
Figure 3C:
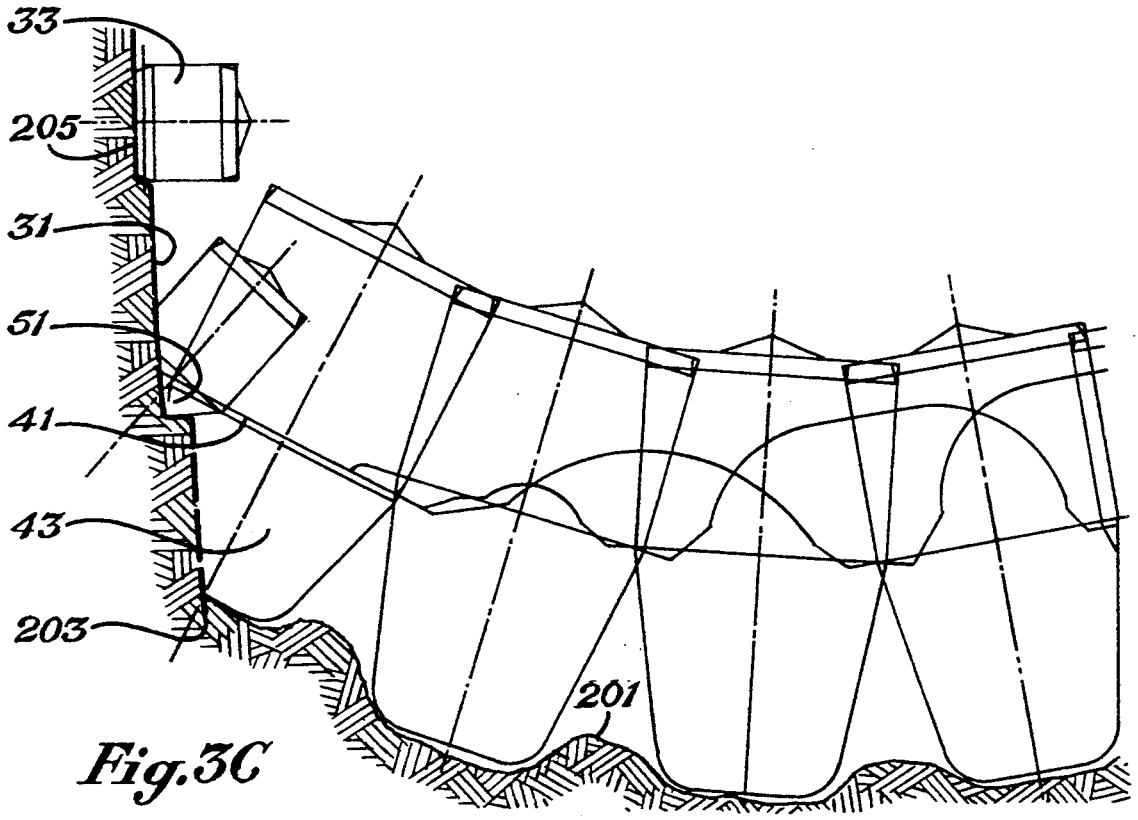

As is more clearly depicted in FIGS. 3A–3C, scraper insert is secured to the cutter shell surface such that one of scraper surfaces 55, 57 defines a gage insert surface that extends generally parallel to the sidewall (205 in FIG. 3A) of the borehole. Another of scraper insert surfaces 55, 57 defines a heel insert surface.

Figure 4:
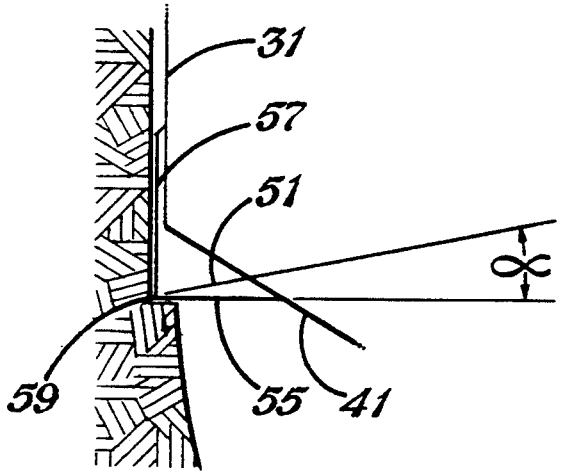
FIG. 4 is an enlarged view of a scraper insert in contact with the sidewall of the borehole.
Figure 5A:
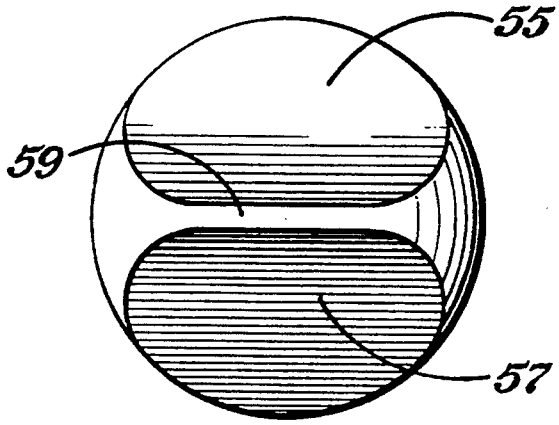
FIGS. 5A and 5B are plan and side elevation views, respectively, of the preferred scraper insert of FIG. 4.
Figure 5B:
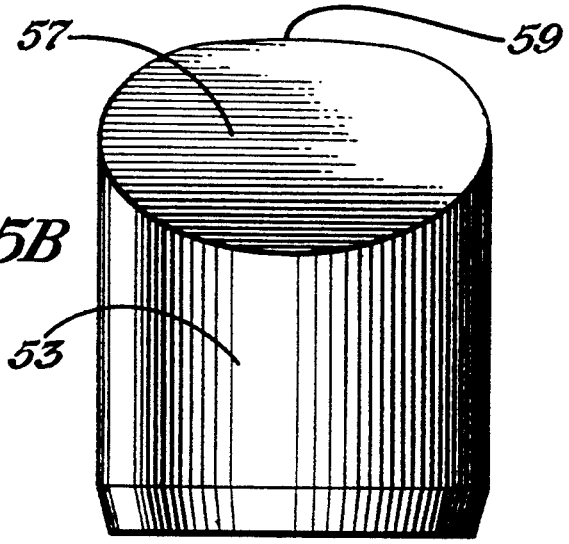

As depicted in FIG. 4, heel insert surface 55 is oriented to define a positive rake angle $\alpha$ (heel insert surface 55 trails cutting edge 59) of between 0 and 15 degrees. The presence of positive rake angle is necessary to achieve efficient cutting of formation material. A negative rake angle that would place heel insert surface 55 ahead of cutting edge 59 would create a nearer-vertical surface in the corner of the borehole, wherein engagement with the corner of the borehole generates lateral forces on cutters 21, 23, 25. Fifteen degrees is believed to be the maximum positive rake angle attainable due to space and geometrical constraints at the intersection of gage and heel surfaces 31, 41. A rake angle of 0 degrees maximizes the ability of cutting edge 59 to cut formation material but also maximizes friction in the cutting process, which is believed to be negligible in predominantly brittle formations.

Figure 2A:
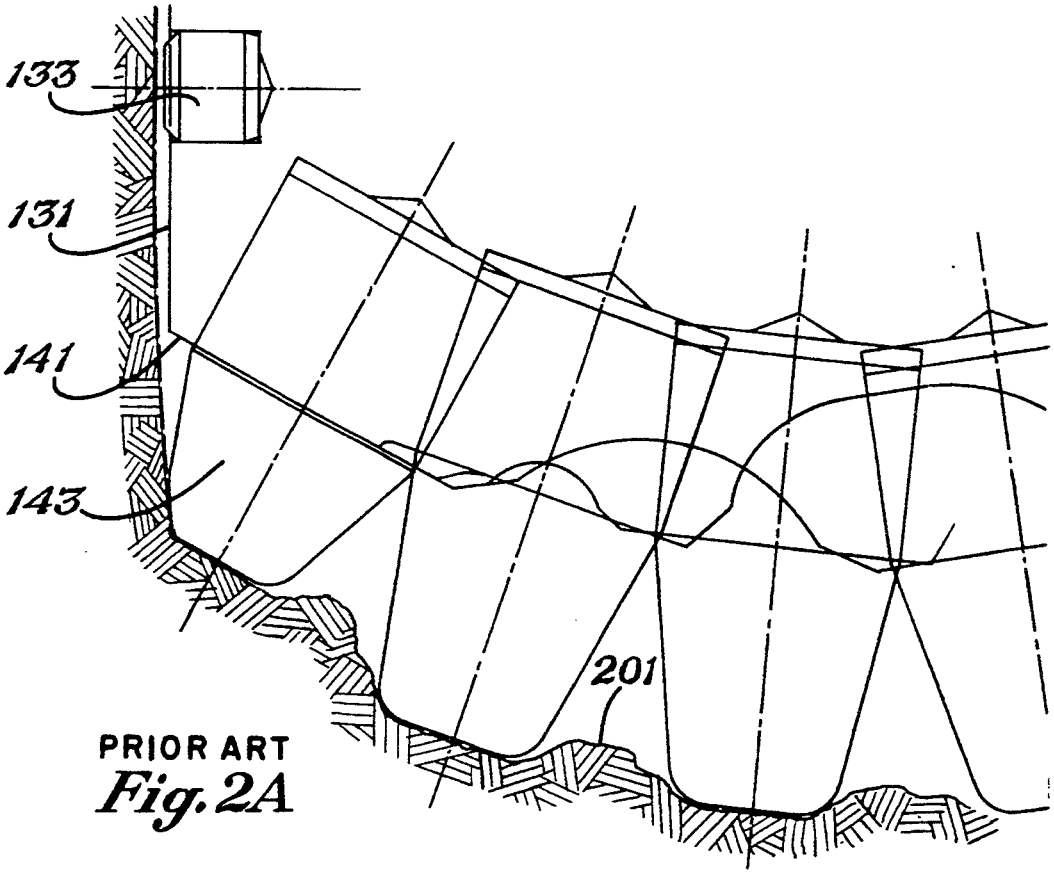
PRIOR ART Fig. 2A
FIGS. 2A through 2C are fragmentary, longitudinal section views showing progressive wear of a prior-art earth-boring bit.
Figure 2B:
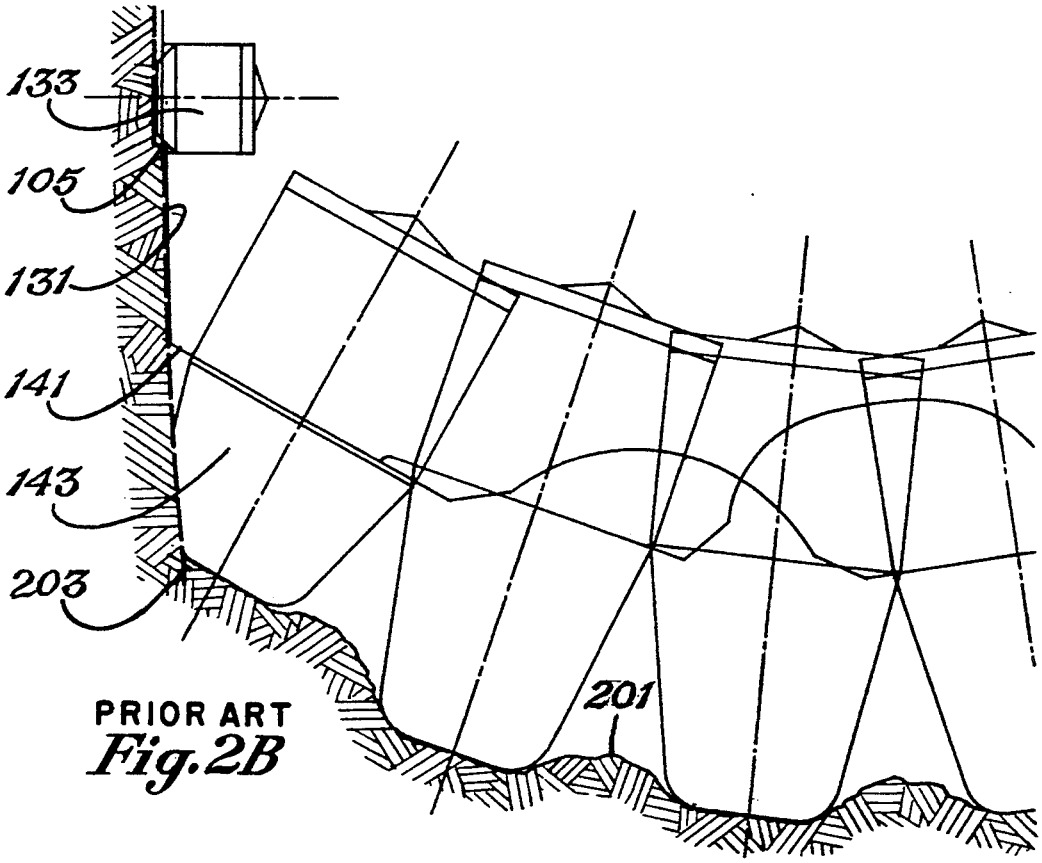
PRIOR ART Fig. 2B

FIGS. 2A–2B are fragmentary, longitudinal section view of the cutting geometry of a prior-art earth-boring bit, showing progressive wear from a new condition to the "rounded gage" condition. The reference numerals in FIGS. 2A–2C that begin with the numeral 1 point out structure that is analogous to that illustrated in earth-boring bit 11 according to the present invention depicted in FIG. 1, e.g., heel tooth or insert 143 in FIG. 2A is analogous to heel insert 43 depicted in FIG. 1, heel surface 141 in FIG. 2A is analogous to heel surface 41 depicted in FIG. 1, etc.

FIG. 2A depicts a prior-art earth-boring bit in a borehole. FIG. 2A depicts the prior-art earth-boring bit in a new or unworn condition, in which the intersection between gage and heel surfaces 131, 141 is prominent and does not contact sidewall 205 of borehole. The majority of the teeth or inserts engage the bottom 201 of the borehole. Heel teeth or inserts 143 engage corner 203 of the borehole, which is generally defined at the intersection of sidewall 205 and bottom 201 of borehole. Gage insert 133 does not yet engage sidewall 205 of the borehole to trim the sidewall and maintain the minimum gage diameter of the borehole.

FIG. 2B depicts the prior-art earth-boring bit of FIG. 2A in a moderately worn condition. In the moderately worn condition, the outer end of heel tooth or insert 143 is abrasively worn, as is the intersection of gage and heel surfaces 131, 141. Abrasive erosion of heel tooth or insert 14! 3 and gage and heel surfaces 131, 141 of cutter shell causes the earth-boring bit to conform with corner 203 and sidewall 205 of the borehole. Thus, gage insert 133 cuts into sidewall 205 of the borehole to maintain gage diameter in the absence of heel inserts' 143 ability to do so. Sidewall of borehole 205 is in constant conforming contact with the cutter shell surface, generally at what remains of the intersection between gage and heel surfaces 131, 141. These two conditions cause the cutters of the prior-art earth-boring bit to be increasingly laterally loaded, which accelerates bearing wear and subsequent bit failure.

Figure 2C:
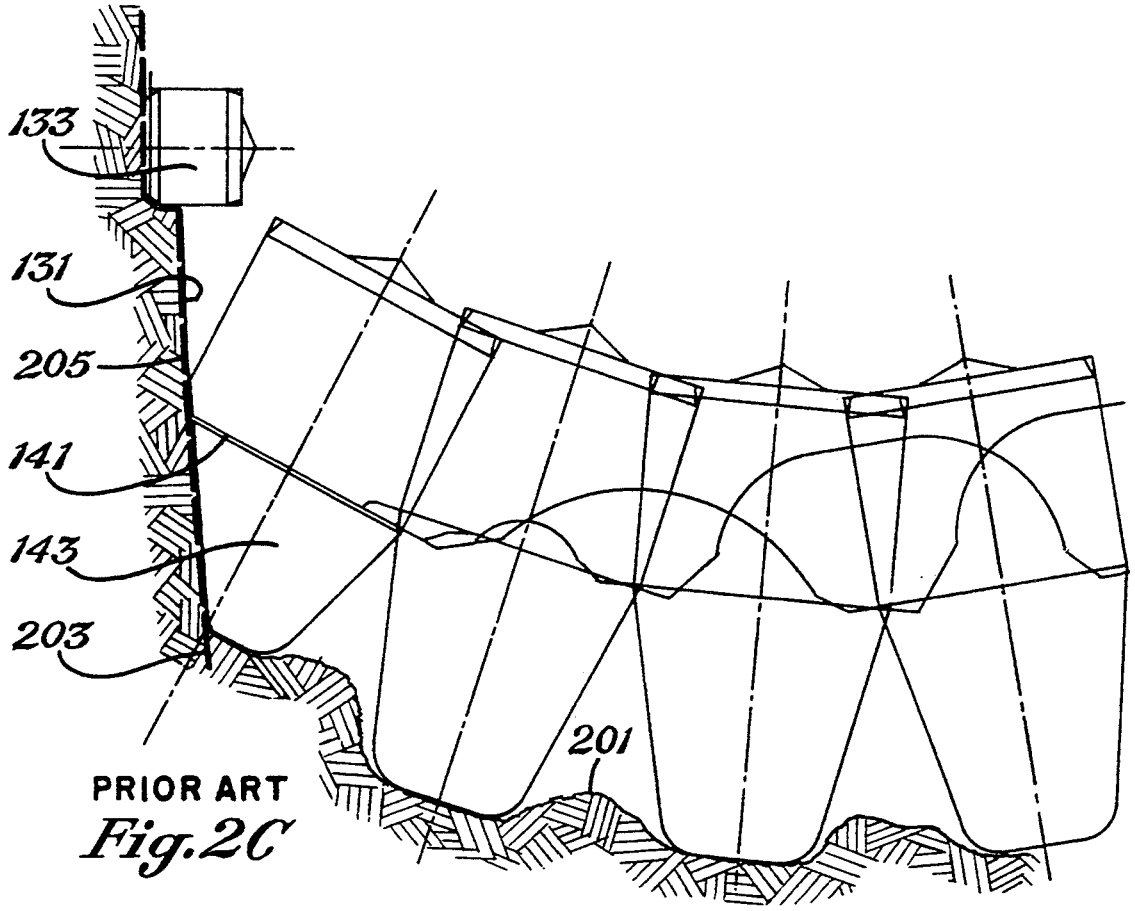
PRIOR ART Fig. 2C

FIG. 2C illustrates the prior-art earth-boring bit of FIGS. 2A and 2B in a severely worn, or rounded gage, condition. In this rounded gage condition, the outer end of heel tooth or insert 143 is severely worn, as is the cutter shell surface generally in the area of the intersection of gage and heel surfaces 131, 141. Moreover, because severely worn heel tooth or insert 143 is now incapable of cutting and trimming sidewall of 205 of the wellbore to gage diameter, gage insert 133 excessively penetrates sidewall 205 of the borehole and bears the bulk of the burden in maintaining gage, a condition for which gage insert 133 is not optimally designed, thus resulting in inefficient gage cutting and lower rates of penetration. Thus, the conformity of the cutter shell surface with corner 203 and sidewall 205 of the borehole, along with excessive penetration of sidewall 205 of the borehole by gage insert 133, are exaggerated over that shown in the moderately worn condition of FIG. 2B. Likewise, the excessive lateral loads and inefficient gage cutting also are exaggerated. Furthermore, excessive erosion of the cutter shell surface may result in loss of either gage insert 133 or heel insert 143, clearly resulting in a reduction of cutting efficiency.

FIGS. 3A–3C are fragmentary, longitudinal section views of earth-boring bit 11 according to the present invention as it progressively wears in a borehole. FIG. 3A illustrates earth-boring bit 11 in a new or unworn condition, wherein the majority of the teeth or inserts engage bottom 201 of the borehole. Heel inserts or teeth 43 engage corner 203 of the borehole. One of scraper insert surfaces (55 and 57 in FIG. 4) 57 defines a gage insert surface 57 that extends generally parallel to sidewall 205 of the borehole. Another of scraper insert surfaces 55, 57 defines a heel insert surface 55 that defines a positive rake angle $\alpha$ with respect to sidewall 205 of the borehole.

Scraper insert 51 is constructed of a material having greater wear-resistance than at least gage and heel surfaces 31, 41 of the cutter shell surface. Thus, the gage insert surface of scraper insert 51 protects gage surface 31 from severe abrasive erosion resulting from contact with sidewall 205 of the borehole. Likewise, the heel insert surface of scraper insert 51 protects heel surface 41 from abrasive erosion resulting from contact with corner 203 of the borehole. Scraper insert 51 also inhibits formation of rock ribs at corner 203 of borehole as bit 11 wears because cutting edge 59 kerfs nascent rock ribs, disintegrating them before they can detract from efficient drilling.

FIG. 3B depicts earth-boring bit 11 in a moderately worn condition in which the outer end of heel tooth or insert 43 is worn, as is the cutter shell generally at the intersection of gage and heel surfaces 31, 41. However, scraper insert 51 has prevented a great deal of the cutter shell erosion, and still functions to kerf corner 203, thereby maintaining a clearance between gage insert 33 and sidewall 205 of the borehole, and avoiding conformity. Thus, the presence of scraper insert 51 promotes cutting efficiency and deters rapid abrasive erosion of the cutter shell surface.

FIG. 3C illustrates earth-boring bit 11 according to the present invention in a severely worn condition in which the outer end of heel tooth or insert 43 is severely worn and the cutter shell surface is only moderately eroded. By preventing excessive cutter erosion, conformity of the cutter shell surface with corner 203 and sidewall 205 of the borehole is avoided, along with the attendant increased lateral loads on cutters 21, 23, 25 and inefficient cutting by gage insert 33. Only in this most severely worn condition, where heel inserts 43 are extremely worn, do gage inserts 33 actively cut sidewall 205 of borehole.

FIG. 4 is an enlarged elevation view of a preferred scraper insert 51 according to the present invention. Scraper insert 51 is formed of a hard metal such as cemented tungsten carbide or similar material having high hardness and abrasion-resistance. As stated before, upon installation of scraper insert 51 by interference fit in an aperture generally at the intersection of gage and heel surfaces 31, 41, one of scraper insert surfaces 55, 57 will define a gage insert surface, and the other of scraper insert surfaces 55, 57 will define a heel insert surface. The gage insert and heel insert surfaces 55, 57 converge at a right angle to define a circumferentially oriented cutting edge 59 for engagement with sidewall 205 of the borehole. Preferably, the radius or width of cutting edge 59 is less than or equal to the depth of penetration of cutting edge 59 into formation material of the borehole as bit 11 wears or rock ribs form.

Efficient cutting by scraper insert 51 requires maintenance of a sharp cutting edge 59. Accordingly, one of scraper insert surfaces 55, 57 preferably is formed of a more wear-resistant material than the other of surfaces 55, 57. The differential rates of wear of surfaces 55, 57 results in a self-sharpening scraper insert 51 that is capable of maintaining a sharp cutting edge 59 over the drilling life of earth-boring bit 11. The more wear-resistant of scraper insert surfaces 55, 57 may be formed of a different grade or composition of hard metal than the other, or could be formed of an entirely different material such as polycrystalline diamond or the like, the remainder of the insert being a conventional hard metal. In any case, scraper insert 51 should be formed of a material having a greater wear-resistance than the material of the cutter shell surface, which is usually steel, so that scraper insert 51 can effectively prevent erosion of the cutter shell surface at the intersection of gage and heel surfaces 31, 41.

In addition to, and perhaps more important than its protective function, scraper insert 59 serves as a secondary cutting structure. The cutting structure is described as "secondary" to distinguish it from primary cutting structure such as heel inserts 43, which have the primary function of penetrating formation material to crush and disintegrate the material as cutters 21, 23, 25 roll and slide over the bottom of the borehole.

As described above, bits 11 having widely spaced teeth are designed to achieve high rates of penetration in soft, low compressive strength formation materials such as shale. Such a bit 11, however, is expected to encounter hard, tough, and abrasive streaks of formation material such as limestones, dolomites, or sandstones. Addition of primary cutting structure, like heel inserts 43 or the inner row inserts, assists in penetration of these hard, abrasive materials and helps prevent cutter shell erosion. But, this additional primary cutting structure reduces the unit load on each tooth or insert, drastically reducing the rate of penetration of bit 11 through the soft material it is designed to drill.

To insure that scraper insert 59 functions only as secondary cutting structure, engaging formation material only when heel insert 43 are worn, or when large rock ribs form while drilling a hard, abrasive interval, the amount of projection of cutting edge 59 from heel surface 41 must be kept within certain limits. Clearly, to avoid becoming primary structure, cutting edge 59 must not project beyond heel surface 41 more than one-half the projection of heel insert 53. Further, to insure that scraper insert 51 engages formation material only when large rock ribs form, the projection of cutting edge 59 must be less than 30% of the pitch between the pair of heel teeth that scraper insert 51 is secured between. Pitch describes the distance or spacing between two teeth in the same row of an earth-boring bit. Pitch, in this case, is measured as the center-to-center linear distance between the crests of any two adjacent teeth in the same row.

Figure 6:
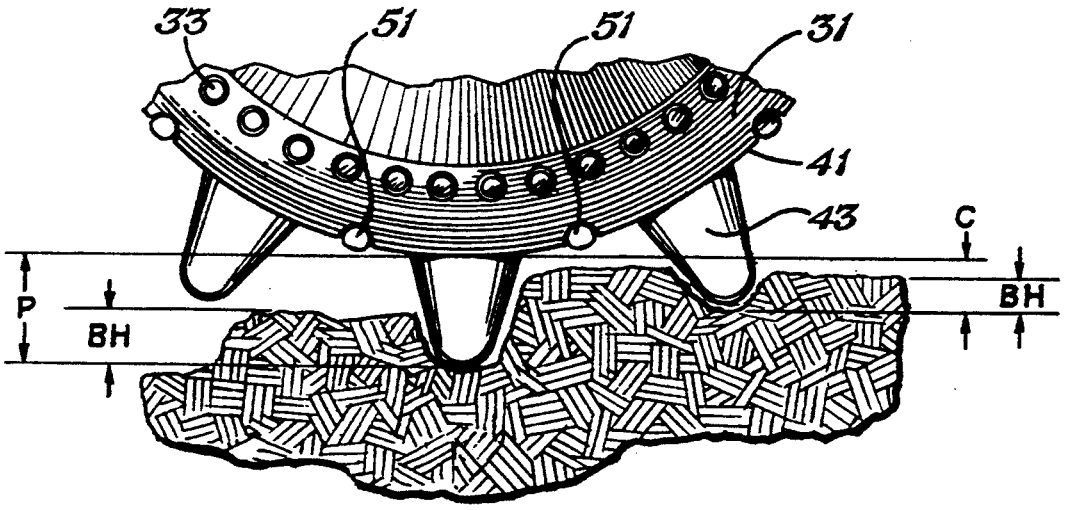
FIG. 6 is a fragmentary section view of a portion of the earth-boring bit according to the present invention in operation in a borehole.

The importance of this limitation becomes apparent with reference to FIG. 6, which depicts a fragmentary view of a portion of an earth-boring bit 11 according to the present invention operating in a borehole. FIG. 6 illustrates the manner in which heel inserts 43 penetrate and disintegrate formation material 301. Heel teeth 43 make a series of impressions 303, 305, 307 in formation material 301. By necessity, there are buildups 309, 311 between each impression. Buildups 309, 311 are expected in most drilling, but in drilling hard, abrasive formations with bits having large-pitch, or widely spaced, heel inserts 43, these buildups can become large enough to detract from bit performance by engaging the cutter shell surface and reducing the unit load on each heel insert 43.

Projection P of heel inserts 43 from heel surface provides a datum plane for reference purposes because it naturally governs the maximum penetration distance of heel inserts 43. Buildup height BH is measured relative to each impression 303, 305, 307 as the distance from the upper surface of the buildup to the bottom of each impression 303, 305, 307. Cutter shell clearance C is the distance between the heel surface 41 and the upper surface of the buildup of interest. As stated above, it is most advantageous that clearance C be greater than zero in hard, tough, and abrasive formations. It has been determined that buildup height BH is a function of pitch and generally does not exceed approximately 30% of the pitch of heel inserts 43, at which point clearance C is zero and as a reduction in unit load on heel inserts 43 and cutter erosion occur.

Thus, to avoid functioning as a primary cutting structure, scraper insert should not engage formation material until buildups 309, 311 begin to enlarge into rock ribs, wherein clearance C approaches zero. This is accomplished by limiting the projection of cutting edge 59 from heel surface 41 to an amount less than 30% of the pitch of the pair of heel inserts 43 between which scraper insert 51 is secured.

For example, for a 12¼ inch bit having a pitch between two heel inserts 43 of 2 inches, and heel inserts 43 having a projection P of 0.609 inch, scraper inserts 51 have a projection of 0.188 inch, which is less than one-half (0.305 inch) projection P of heel inserts 43 and 30% of pitch, which is 0.60 inch. In the case of extremely large heel pitches, i.e. greater than 2 inches, it may be advantageous to place more than one scraper insert 51 between heel inserts 43.

With reference now to FIGS. 1 and 3A–6, the operation of improved earth-boring bit 11 according to the present invention will be described. Earth-boring bit 11 is connected into a drillstring (not shown). Bit 11 and drillstring are rotated in a borehole causing cutters 21, 23, 25 to roll and slide over bottom 201 of the borehole. The inserts or teeth of cutters 21, 23, 25 penetrate and crush formation material, which is lifted up the borehole to the surface by drilling fluid exiting nozzle 19 in bit 11.

Heel inserts or teeth 43 and gage inserts 33 cooperate to scrape and crush formation material in corner 203 and sidewall 205 of the borehole, thereby maintaining a full gage or diameter borehole and increasing the rate of penetration of bit 11 through formation material. Scraper inserts 51, being secondary cutting structure, contribute to the disintegration of hard, tough, and abrasive intervals when the formation material forms enlarged rock ribs extending from corner 203 up sidewall 205 of the borehole. During drilling of the softer formation materials, scraper inserts make only incidental contact with formation material, thus avoiding reduction in unit load on primary cutting structure such as heel inserts 43.

As heel inserts or teeth 43 wear, scraper inserts 51 protect the cutter shell surface from abrasive erosion and conformity with corner 203 and sidewall 205 of the borehole, and also promote efficient cutting of sidewall 205 of the borehole by gage inserts 33. Thus, earth-boring bit 11 according to the present invention is less susceptible to the rounded gage condition and the attendant increased lateral loading of cutters 21, 23, 25, inefficient gage cutting, and resulting reduced rates of penetration.

The principal advantage of the improved earth-boring bit according to the present invention is that it possesses the ability to maintain an efficient and effective cutting geometry over the drilling life of the bit, resulting in a bit having a higher rate of penetration through both soft and hard formation materials, which results in more efficient and less costly drilling.

The invention is described with reference to a preferred embodiment thereof. The invention is thus not limited, but is susceptible to variation and modification without departing from the scope and spirit thereof.

We claim:

1. An earth-boring bit having improved ability to maintain an efficient cutting geometry as the earth-boring bit encounters a mix of hard and soft formation material, and as the earth-boring bit wears during drilling operation, the earth-boring bit comprising:

a bit body;

at least one cutter rotatably secured to the bit body and having an axis of rotation, the cutter having a cutter shell surface including at least a gage surface intersecting a heel surface;

a plurality of cutting teeth arranged in generally circumferential rows on the cutter, including a heel row of heel teeth on the heel surface of the cutter and a gage row of gage inserts secured by interference fit to the gage surface of the cutter; and a secondary cutting structure including at least one scraper insert formed of material more wear-resistant than that of the cutter shell surface and secured by interference fit to the cutter shell surface generally at the intersection of the gage and heel surfaces and generally intermediate a pair of heel teeth having a pitch therebetween and a projection from the heel surface, the scraper insert including a gage insert surface and a heel insert surface, the gage and heel insert surfaces converging to define a cutting edge for engagement with the sidewall of the borehole and, the cutting edge protruding from the heel surface a distance not greater than the lesser of one-half the projection of the heel teeth and 30% of the Ditch between the pair of heel teeth.

2. The earth-boring bit according to claim 1 wherein the scraper insert is formed such that one of the gage and heel insert surfaces thereof is formed of a more wear-resistant material than the other surface, wherein the scraper insert is self-sharpening.

3. The earth-boring bit according to claim 1 wherein the scraper insert alternates with each heel tooth.

4. The earth-boring bit according to claim 1 wherein the earth-boring bit is provided with three cutters, each cutter having heel teeth and a gage row of inserts, each heel row tooth alternating with the scraper insert and at least one gage insert.

5. An earth-boring bit having improved ability to maintain an efficient cutting geometry as the earth-boring bit encounters a mix of hard and soft formation material, and as the earth-boring bit wears during drilling operation, the earth-boring bit comprising:

a bit body;

at least one cutter rotatably secured to the bit body, the cutter having a cutter shell surface including at least a gage surface intersecting a heel surface;

a plurality of hardmetal inserts arranged in generally circumferential rows and secured to the cutter by interference fit, the plurality of hardmetal inserts including a heel row of heel inserts on the heel surface of the cutter; and a secondary cutting structure including at least one scraper insert formed of material more wear-resistant than that of the cutter shell surface and secured to the cutter shell surface generally at the intersection of the gage and heel surfaces and generally intermediate a pair of heel row inserts, the scraper insert including a gage insert surface and a heel insert surface, the gage and heel insert surfaces converging to define a cutting edge for engagement with the sidewall of the borehole, and the heel insert surface defining a positive rake angle with respect to the sidewall of the borehole of between 0 and 15 degrees, one of the gage and heel insert surfaces being formed of a more wear-resistant material than the other surface, wherein the scraper insert is self-sharpening.

6. The earth-boring bit according to claim 5 wherein the scraper insert alternates with each heel row insert.

7. The earth-boring bit according to claim 5 wherein the earth-boring bit is provided with three cutters, each cutter having a heel row of inserts and a gage row of gage inserts on the gage surface, each heel row insert alternating with a scraper insert and at least one gage insert.

8. An earth-boring bit having improved ability to maintain an efficient cutting geometry as the earth-boring bit encounters a mix of hard and soft formation material, and as the earth-boring bit wears during drilling operation, the earth-boring bit comprising:

a bit body;

at least one cutter rotatably secured to the bit body, the cutter having a cutter shell surface including at least a gage surface intersecting a heel surface; a plurality of hardmetal inserts arranged in generally circumferential rows and secured to the cutter by interference fit, the plurality of hardmetal inserts including a heel row of heel inserts on the heel surface of the cutter and a gage row of gage inserts on the gage surface of the cutter; and a secondary cutting structure including at least one scraper insert formed of material more wear-resistant than that of the cutter shell surface and secured to the cutter shell surface generally at the intersection of the gage and heel surfaces and generally intermediate a pair of heel row inserts having a pitch therebetween, the scraper insert including a gage insert surface and a heel insert surface, the gage and heel insert surfaces converging to define a circumferential cutting edge for engagement with the sidewall of the borehole and, the heel insert surface defining a positive rake angle with respect to the sidewall of the borehole of between 0 and 15 degrees, the cutting edge protruding from the heel surface a distance not greater than the lesser of the projection of the heel row inserts and 30% of the pitch between the pair of heel row inserts.

9. The earth-boring bit according to claim 8 wherein the scraper insert is formed such that one of the gage and heel insert surfaces is formed of a more wear-resistant material than the other surface, wherein the scraper insert is self-sharpening.

10. The earth-boring bit according to claim 8 wherein the scraper insert alternates with each heel row insert.

11. The earth-boring bit according to claim 8 wherein the earth-boring bit is provided with three cutters, each cutter having a heel row of inserts and a gage row of inserts, each heel row insert alternating with a scraper insert and at least one gage insert.

* * * * *